US007356278B2

(12) United States Patent
Piotrowski et al.

(10) Patent No.: US 7,356,278 B2
(45) Date of Patent: Apr. 8, 2008

(54) CLEANING MEMBER FOR CHARGING DEVICE

(75) Inventors: James Christopher Piotrowski, Lexington, KY (US); Donald Wayne Stafford, Georgetown, KY (US); DeAndre Stevis Thompson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/095,116

(22) Filed: Mar. 31, 2005

(65) Prior Publication Data

US 2006/0222399 A1 Oct. 5, 2006

(51) Int. Cl.
*G03G 15/02* (2006.01)

(52) U.S. Cl. ..... 399/100

(58) Field of Classification Search ..... 399/100
See application file for complete search history.

(56) References Cited

U.S. PATENT DOCUMENTS

| | | | | |
|---|---|---|---|---|
| 4,931,839 A | | 6/1990 | Tompkins et al. | 355/277 |
| 4,999,678 A | | 3/1991 | Tange | 355/297 |
| 5,568,243 A | | 10/1996 | Durfee et al. | 355/299 |
| 5,572,293 A | | 11/1996 | Kikuchi et al. | 399/357 |
| 5,610,691 A | * | 3/1997 | Takahashi et al. | 399/176 |
| 5,799,229 A | * | 8/1998 | Yokoyama et al. | 399/100 |
| 6,029,029 A | * | 2/2000 | Danzuka | 399/100 |
| 6,263,175 B1 | * | 7/2001 | Sawada et al. | 399/100 |
| 6,334,034 B1 | | 12/2001 | Kitazawa et al. | 399/100 |
| 6,389,255 B1 | | 5/2002 | Sawada et al. | 399/176 |
| 6,503,615 B1 | | 1/2003 | Horii et al. | 428/316.6 |
| 6,701,105 B2 | | 3/2004 | Funabashi | 399/100 |
| 6,751,427 B2 | | 6/2004 | Sugiura | 399/100 |
| 2005/0191081 A1 | * | 9/2005 | Muraishi et al. | 399/100 |

FOREIGN PATENT DOCUMENTS

| | | | |
|---|---|---|---|
| JP | 01038778 A | * | 2/1989 |
| JP | 3101768 | | 4/1991 |

OTHER PUBLICATIONS

Overview of Lexmark T520, T522 High Yield Return Program Print Cartridge (1 pg) http://www.lexmark.com/uncomplicate/product/home.

Diagram of Lexmark Charge Roll Cleaner Used In Lexmark T520 and T522 Cartridges (1 pg).

* cited by examiner

*Primary Examiner*—David M. Gray
*Assistant Examiner*—Joseph S. Wong
(74) *Attorney, Agent, or Firm*—Steven J. Grossman

(57) ABSTRACT

The present invention relates to printing devices and particularly to devices and a method for the reduction of contamination on a charging device. A cleaning member is supplied that has a cleaning material affixed to a substrate. The cleaning material is positioned to contact the charge roller and the substrate is flexed to provide an elastic response.

16 Claims, 7 Drawing Sheets

CLEANING MEMBER FOR CHARGING DEVICE

FIELD OF INVENTION

The present invention relates to printing devices which may require cleaning of a charging member.

BACKGROUND

In printing devices a charge roller may be used to apply a uniform electrical potential to the surface of a photoconductor (PC), which may be shaped as a drum. The surface of the PC may then be selectively exposed to a laser beam in a pattern corresponding to the image to be printed. The areas of the PC that are exposed are electrically discharged, thus forming a latent electrostatic image on the PC. Toner may then be transferred to the surface of the PC, which is attracted to and clings to the electrostatic image formed on the PC surface by the laser beam. From the PC surface, the toner may then be transferred to media via electrostatic interactions. The toner may then be fused to the media.

After this process the PC surface may be cleaned using a cleaning blade. Untransferred toner, toner additives, paper dust, and other foreign debris may be removed from the PC by the cleaning blade. However, when the contaminants bypass the cleaning blade, they may be transferred from the PC surface to the charge roller. These contaminants may adhere to the charge roller, coating the roller and causing the roller to become rough and dirty. Charge roller contamination may deteriorate the charging ability of the charge roller and cause degradation of image quality, causing defects which may include background fouling and density unevenness.

SUMMARY

In one exemplary embodiment the present invention relates to a cleaning device for removing particulate from a charging device in an electrophotographic device comprising an elongated substrate including a pad comprising open-cell foam capable of absorbing particulate. The substrate may be capable of being flexed and has first and second portions, wherein said substrate may be capable of being positioned between the charging device and a surface in the electrophotographic device. The first and second portions may define an angle of less than 180 degrees. The substrate, as positioned between the charging device and a surface in the printer may apply a pressure onto the pad when the pad contacts the charging device.

In another exemplary embodiment, the present invention relates to an electrophotographic printing device comprising a photoconductor; a charging device contacting said photoconductor, and an elongated substrate including a pad comprising open-cell foam capable of absorbing particulate. The substrate may be capable of being flexed and has first and second portions. The substrate may be capable of being positioned between the charging device and a surface in the electrophotographic device so that the first and second portions define an angle of less than 180 degrees. The substrate, as positioned between the charging device and a surface in the printer may apply a pressure onto the pad when the pad contacts the charging device.

In another exemplary embodiment, the present invention is directed at a method of cleaning a charging device in a printer comprising supplying an elongated substrate including a cleaning material comprising open-celled foam capable of absorbing particulate. The substrate has first and second portions wherein the first portion and second portion may define an angle of less than 180 degrees. The substrate is capable of being positioned as between a charging device and a surface in the printer. The substrate may be flexed as between the charging device and the surface in the printer wherein the flexing may provide an elastic response.

In another exemplary embodiment the present invention is directed at a cleaning device for a printer comprising an elongated substrate including a cleaning material comprising open cell foam capable of absorbing particulate. The substrate may be in a flexed state and exhibit an elastic response. The substrate has first and second portions wherein the first portion and second portion define an angle of less than 180 degrees.

BRIEF DESCRIPTION OF DRAWINGS

Features and advantages of the present invention are set forth herein by description of embodiments consistent with the present invention, which description should be considered in conjunction with the accompanying drawings, wherein.

DETAILED DESCRIPTION

Figure 1:
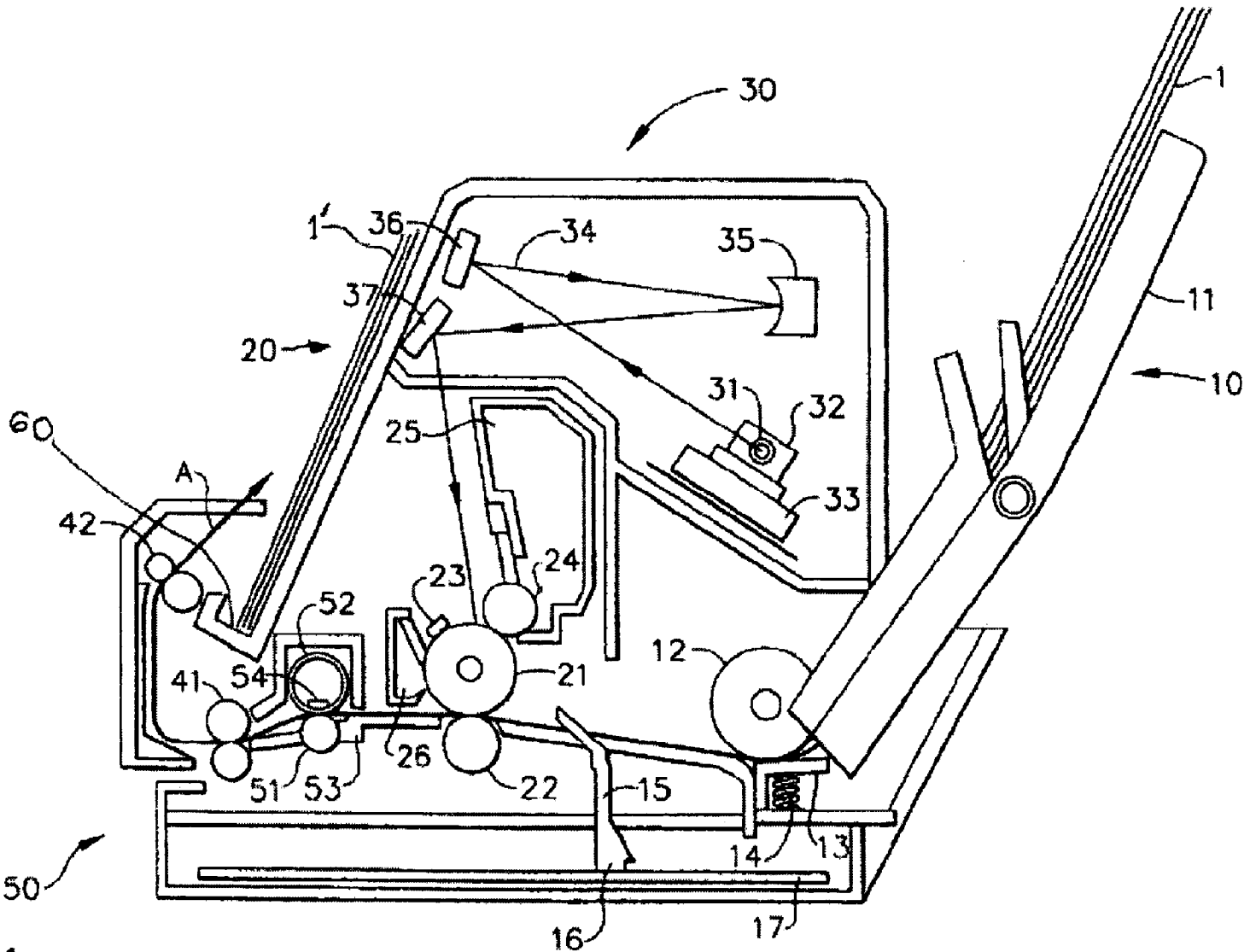
FIG. 1 is a side view of an exemplary electrophotographic printing device (the charging device cleaner not illustrated).

An exemplary embodiment of an electrophotographic device may include the laser printer depicted in FIG. 1. The printer may include a media feed section (10), an image-forming device (20), a laser scanning section (30), and fixing device (50). The paper feed section (10), may sequentially transport sheets of recording media (or other printing media) (1) to the image-forming device (20) provided in the printer. The image forming device (20) may then transfer a toner image to the transported sheet of recording media (1). The fixing device (50) may fix toner to the sheet of recording media (1) sent from the image forming device (20). Thereafter, the sheet of recording media (1) may be ejected out of the printer by paper transport rollers (41, 42) and into the output bin (60) and shown as 1'. In short, the sheet of media (1) moves along the path denoted by the arrow (A) in FIG. 1. The media feed section (1) may include a feed tray (11), a feed roller (12), a paper separating friction plate (13), a pressure spring (14), a media detection actuator (15), a media detection sensor (16), and a control circuit (17).

Upon receiving a print instruction, the sheets of recording media (1) which have been placed in the media feed tray (11) may be fed one-by-one into the printer by operation of the printer feed roller (12), the media separating friction plate (13) and the pressure spring (14). As the fed sheet of paper (1) pushes down the media detection actuator (15), the media detection sensor (16) may output an electrical signal instructing commencement of printing the image. The control circuit (17), started by operation of the paper detection actuator (15) may transmit an image signal to a laser diode light-emitting unit (31) of the laser scanning section (30) so as to control on/off of the light-emitting diode.

The laser scanning section (30) may include a laser diode light-emitting unit (31), a scanning mirror (32), a scanning mirror motor (33), and reflecting mirrors (35, 36 and 37). The scanning mirror (32) may be rotated at a constant high speed by the scanning mirror motor (33). In other words, laser light (34) may scan in a vertical direction to the paper surface of FIG. 1. The laser light (34) radiated by the laser diode light-scanning unit (31) may be reflected by the reflecting mirrors (35, 36 and 37) so as to be applied to the photosensitive body (21). When the laser light (34) is applied to the photosensitive body (21), the photosensitive body, or photoconductor, (21) may be selectively exposed to the laser light (34) in accordance with on/off information from this control circuit (17).

The image-forming device (20) may include the photosensitive body (21), a transfer roller (22), a charging member (23), a developing roller (24), a developing unit (25), and a cleaning unit (26). The surface charge of the photosensitive body (21), charged in advance by the charging member (23) may be selectively discharged by the laser light (34). An electrostatic latent image may thus be formed on the surface of the photosensitive body (21). The electrostatic latent image may be visualized by the developing roller (24), and the developing unit (25). Specifically, the toner supplied from the developing unit (25) may be adhered to the electrostatic latent image on the photosensitive body (21) by the developing roller (24) so as to form the toner image.

Toner used for development may be stored in the developing unit (25). The toner may contain coloring components (such as carbon black for black toner) and thermoplastic components. The toner, may be charged by being appropriately stirred in the developing unit (25), may adhere to the above-mentioned electrostatic latent image by an interaction of the developing bias voltage applied to the developing roller (24) and an electric field generated by the surface potential of the photosensitive body (21), and may thus conform to the latent image, forming a visual image on the photosensitive body (21). The toner may a negative charge when it is applied to the latent image, forming the visual image.

Next, the sheet of paper (1) transported from the feed section (10) may be transported downstream while being pinched by the photosensitive body (21) and the transfer roller (22). The paper (1) may arrive at the transfer nip in timed coordination with the toned image on the photosensitive body (21). As the sheet of paper (1) is transported downstream, the toner image formed on the photosensitive body (21) may be electrically attracted and transferred to the sheet of paper (1) by an interaction with the electrostatic field generated by the transfer voltage applied to the transfer roller (22). Any toner that still remains on the photosensitive body (21), not having been transferred to the sheet of paper (1), may be collected by the cleaning unit (26). Thereafter, the sheet of paper (1) may be transported to the fixing device (50). In the fixing device (50), an appropriate temperature and pressure may be applied while the sheet of paper (1) is being pinched by moving through the nip formed by a pressure roller (51) and the fixing roller or belt (52) that may be maintained at an elevated temperature. The thermoplastic components of the toner may be melted by the fuser belt (52) and fixed to the sheet of paper (1) to form a stable image. The sheet of paper (1) may then be transported and ejected out of the printer by the printer transport rollers (41, 42) and may be placed into an output bin (60) where it may be stacked, one sheet (referenced as 1') of printed paper upon another.

The fixing belt (52) may generally have an endless belt or tube formed from a highly heat resistive and durable material having good parting properties and a thickness of not more than about 100 μm, preferably not more than about 70 μm. Preferred belts are made from a polyimide film. The belt may have an outer coating of, for example, a fluororesin or Teflon® material to optimize release properties of the fixed toner from the belt. Such fuser belts are well-known in the art. A heater (54), generally a ceramic heater, may be placed on the inside surface of the belt and the outside surface of the belt forms a fusing nip (66) with the backup roller (51) at the location of the heater. Put another way, the heater (54) and the backup roller (51) with the fuser belt (52) interposed between them form the nip (66). Each sheet carrying the toner may travel through this nip [i.e., between the fuser belt (52) and the backup roller (51)] and the toner may be fixed on the sheet through the combination of applied heat, the time the page is in the fuser nip, and pressure. The polyimide belt is typically thin so that heat may be readily transferred from heater (54). The pressure or backup roller (51) has a thermal mass that may be sufficient to store thermal energy received from the heater (54). The pressure between the fuser belt (52) and the backup roller (51) at the fuser nip (66) may be from about 5 psi to 30 psi. While the fuser belt (52) may be driven itself, often this is not the case. Generally, the backup roller (51) is rotated and it is the friction between the surface of the backup roller (51), and the printed sheet and ultimately the surface of the fuser belt (52), which causes the fuser belt (52) to rotate.

The backup or pressure roller (51) may be generally cylindrical in shape. It may be made from or is coated with a material that has good release and transport properties for the paper (1). The backup roller (51) may be sufficiently soft so as to allow it to be rotated against the fuser belt (52) to form a nip (66) through which the printed sheets of paper travel. By going through this nip, printed sheets may be placed under pressure and the combined effects of this pressure, the time the sheet is in the nip, and the heat from the fuser belt (52) acts to fix the toner onto the media. A preferred material for use in forming the backup roller (51) is silicone rubber. The roller may have an aluminum core with a silicone rubber layer molded or adhesively bonded onto its surface. This roller may also have a fluoropolymer (e.g., Teflon® sleeve or coating). The backup roller may be essentially hollow, having a metallic core, an outer metallic shell surrounding and essentially concentric with the core, and ribs between the core and the outer shell.

Figure 2:
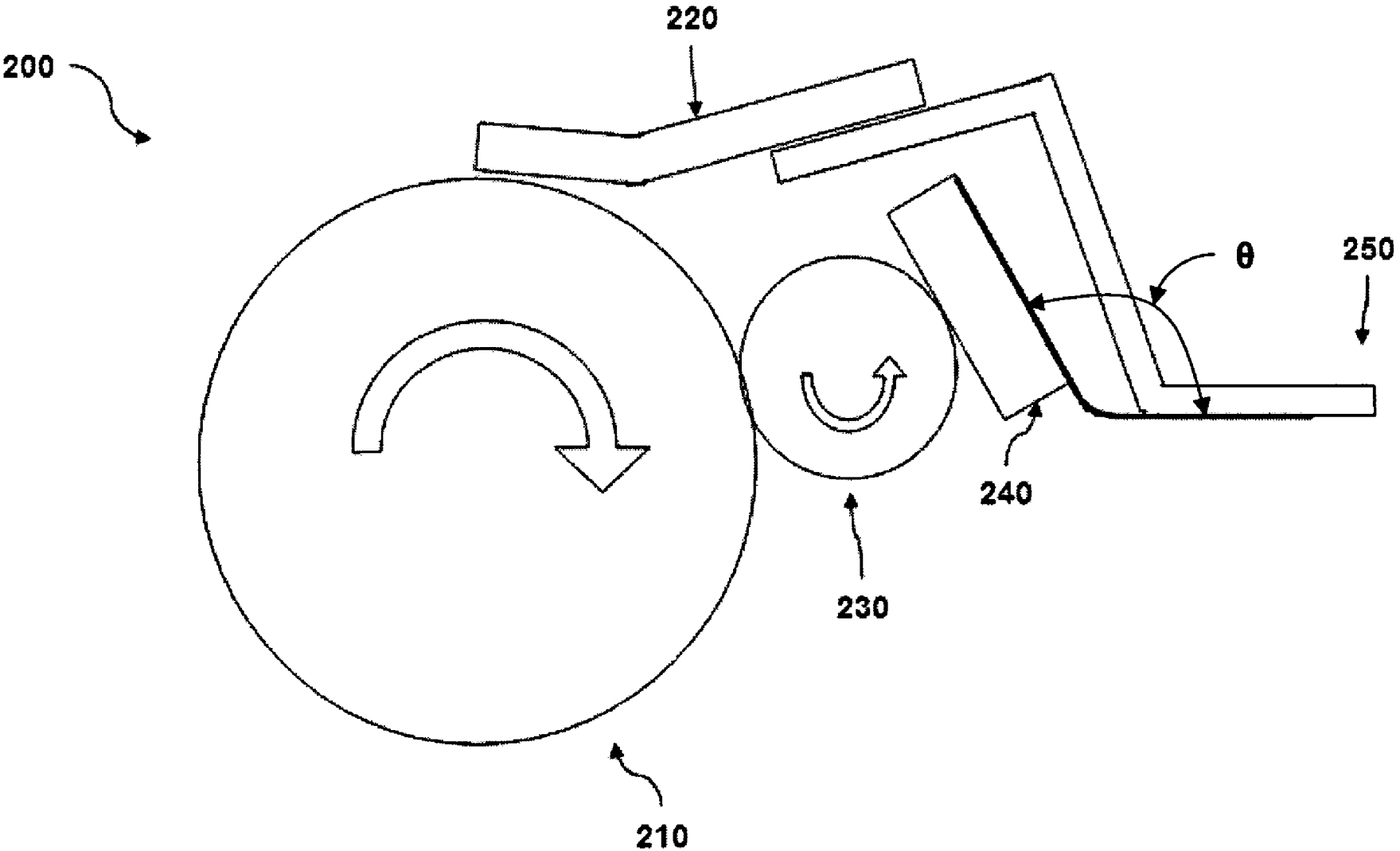
FIG. 2 is a side view of an exemplary embodiment of the present invention of a photoconductor unit with a cantilevered charging device cleaner.

An embodiment of a photoconductor unit of an electrophotogrphic device, consistent with the present invention, is illustrated in FIG. 2. The surface of the photoconductor (210) may be charged to a uniform electrical potential by a charge roller (230). The surface of the PC may be selectively exposed to a laser beam (depicted in FIG. 1) in a pattern corresponding to the image to be printed. The areas of the PC that are exposed may be electrically discharged, thus forming a latent electrostatic image. Toner may then be transferred to the PC, (illustrated in FIG. 1). The toner may be attracted and cling to the electrostatic image formed on the PC surface by the laser beam. From the PC, the toner may be transferred onto a sheet of media, which may then be fused to the paper (also illustrated in FIG. 1).

After the toner has been transferred onto a sheet of media, the cleaning blade (220) may remove debris from the surface of the photoconductor (210). However, some debris may remain on the PC. Debris remaining on the PC may then be transferred to the charge roller (230) causing contamination of the charge roller. Debris may include, but not limited to, untransferred toner, toner additives, paper dust and other foreign debris.

To clean the charge roller, in one embodiment of the present invention, a cleaning member (240) may contact the charge roller (230). Through such contact pressure may be applied onto the charge roller (230) by the cleaning member (240). For example, one may mechanically deform the cleaning member, such as by deflecting or flexing the cleaning member (240) and attaching the cleaning member (240) to the bracket (250), so that when contacting the charge roller (230), the cleaning member (240) generates a pressure against charge roller (230). It should be appreciated that bracket (250) is representative of any surface within a printer upon which the cleaning member may be attached.

The bracket (250) may be located within the printer proximate to the charge roller (230). In one embodiment, the bracket may be the same bracket or affixed or of unitary construction with respect to the bracket carrying the cleaning blade (220) of the photoconductor. In another embodiment the bracket may simply be another surface in the printer that serves as an attachment point for the cleaning member (240).

Figure 3:
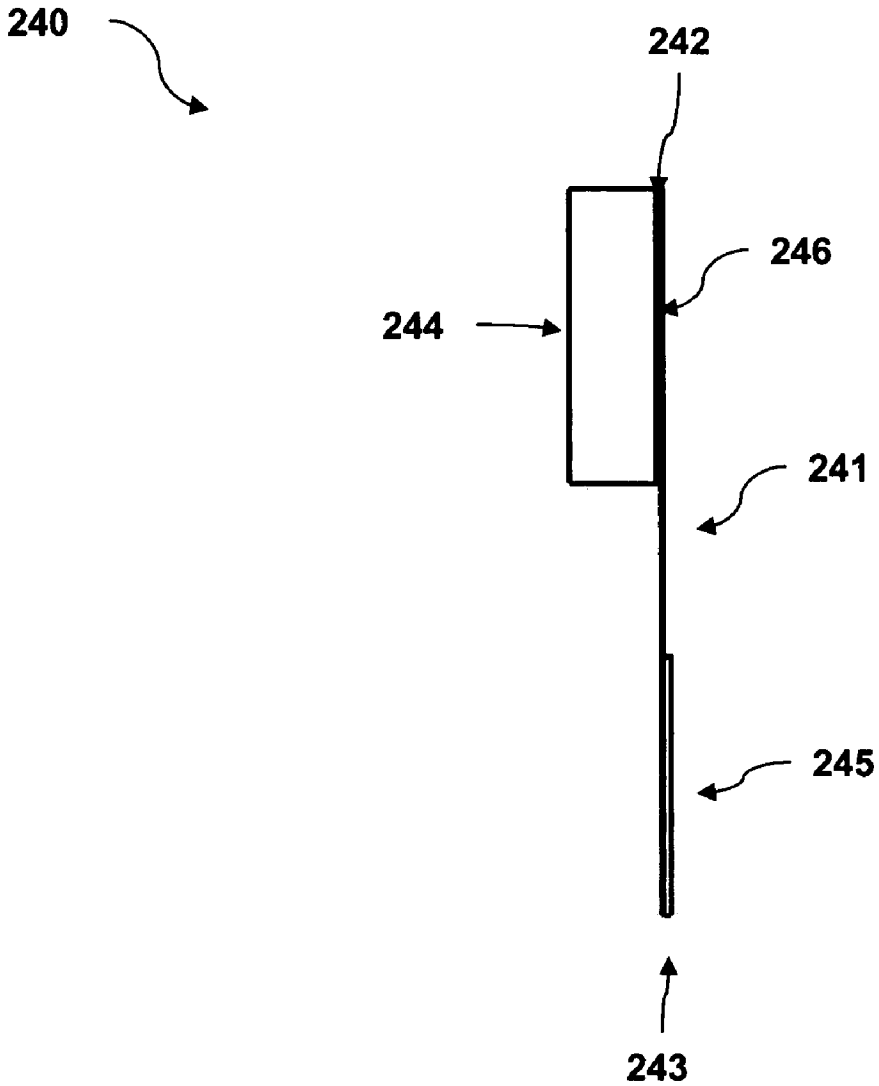
FIG. 3 is a side view of an exemplary embodiment of the charging member cleaning device of the present invention.

FIG. 3 illustrates the cleaning member (240). The cleaning member (240) may be composed of a substrate material (241) having a proximal end (242) and a distal end (243). Upon the proximal end (242) a cleaning pad (244) may be affixed. The substrate material (241) may be provided in an unshaped state or undeflected state (illustrated in FIG. 3) or may be provided as shaped, wherein the shapes may include those illustrated in FIGS. 4-6.

Figure 4:
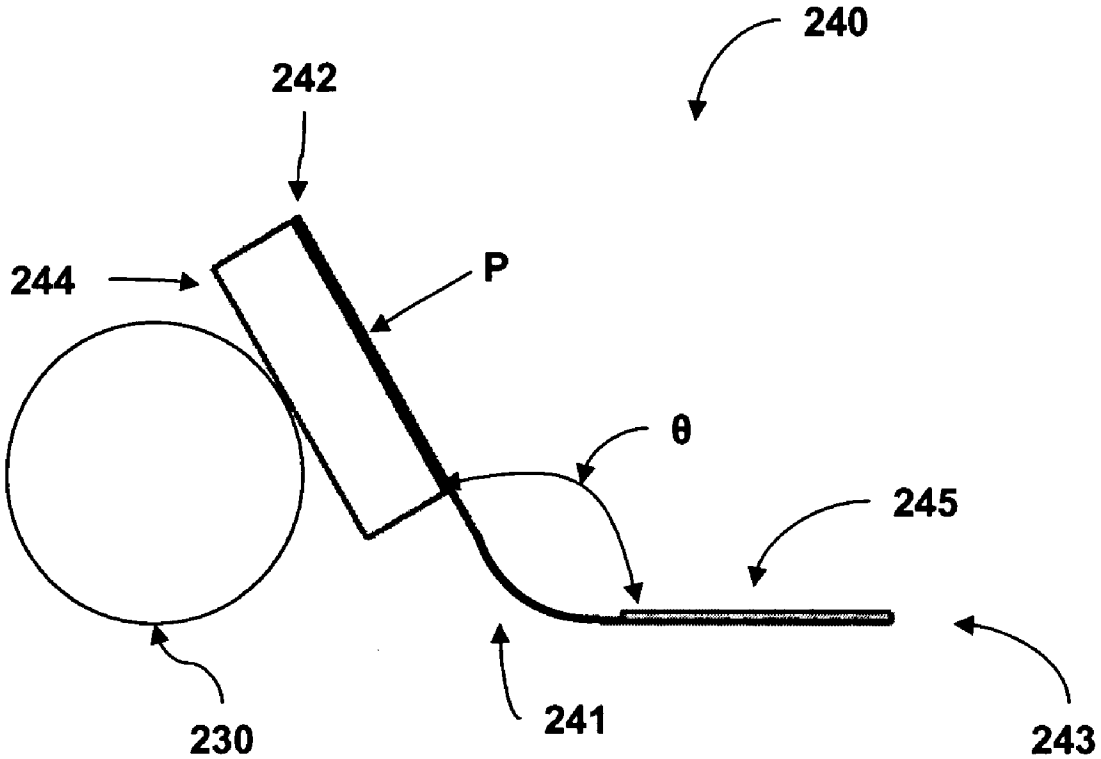
FIG. 4 is a side view of an exemplary embodiment of the charging member cleaning device of the present invention.

In such embodiments illustrated in FIGS. 4, the substrate may be positioned into the general configuration wherein the first or proximal end (242) is angled to the second or distal end (243). The angle θ may be less than 180 degrees and greater than 0 degrees and all increments therebetween including 170 degrees, 45 degrees, 96 degrees, etc. The second end (243) may be attached to a surface within the printer, such as a bracket (250, as illustrated in FIG. 2) or any other surface such as those within the image forming device (20 illustrated in FIG. 1) positioning the substrate (241) between the charging device and a surface within the printer.

In that regard, the substrate material is selected so that it can be flexed when it is positioned as between the charge roller and bracket (250) as illustrated in FIG. 2. When flexed, the substrate material may exhibit an elastic response. This elastic response may simply be realized by the application of a pressure P to the charge roller (230) by the substrate (241) effectuated through the cleaning pad (244).

With respect to the angle θ illustrated in FIG. 2, the flexure of a substrate suitable may be between 100-130+/−15 degrees and all incremental values therebetween including 110+/−15 degrees, 115+/−15 degrees, 120+/−15 degrees, etc. More generally, for a substrate that is initially flat, the flexure may be greater than 0 and up to an including 180 degrees, and all incremental values therebetween, including 10 degrees, 115 degrees, 164 degrees, etc.

Accordingly, a suitable cleaning pressure may be 0.01-5.0 psi and all incremental values therebetween, including 1.0 psi, 2.0 psi, 3.0 psi, etc. Such pressure may therefore assist in cleaning of the charge roller. Therefore, any substrate material that flexes to provide pressure to the charge roller, when positioned between the charge roller and supporting surface in the printer, would be suitable for use in the present invention.

In one embodiment, the substrate may be a polymer strip, and may be either a thermoplastic or thermoset material. The polymer may include polyester, such as polyethylene terephthalate (PET), polycarbonate, polyetherimide, and other polymers. For example, the substrate may include elastomeric materials such as natural or synthetic rubbers, thermoplastic elastomers (e.g., styrene-butadiene copolymers, polyurethane elastomers, polyester-based elastomers) as well as thermoset elastomers. All such polymers may be present as a film (e.g. extruded or cast) or as a molded substrate. Furthermore, substrate (241) may also comprise a non-polymeric material, such as a metallic strip or composite or ceramic material.

The substrate material may have a flexural modulus $E_{flex}$ of less than or equal to about 400,000 psi. It may also include a material that has a $E_{flex}$ between 5000-400,000 psi, including all values and increments therebetween. For example, a $E_{flex}$ of 10,000 psi-100,000 psi may be employed. The substrate material may also preferably exhibit little to no creep (strain deformation v. time) through-out the lifecycle of the printer at relevant working temperatures of the electrophotographic device. In this manner, the substrate may apply a fairly uniform pressure to the roller through-out its intended lifetime of use to support the cleaning pad (244). In addition, regardless of modulus values, the substrate may have a thickness between 0.001 inches (0.0254 mm) and 0.010 inches (0.254 mm), and all increments therebetween including 0.002 inches (0.0508 mm), 0.004 inches, (0.1016 mm) etc.

Referring again to FIG. 3, affixed to the proximal end of the strip (242) may be a cleaning pad (244). The cleaning pad (244) may be rectangular in shape, illustrated in FIG. 3, or may be any shape, including but not limited to, triangular illustrated in FIG. 6, trapezoidal, round, or concave illustrated in FIG. 5. In one embodiment the foam pad may have an overall length between 4.0 to 8.0 mm and an overall thickness between 0.5 to 4.0 mm, and all increments therebetween including lengths and thicknesses of 5.00 mm by 1.5 mm, 6.8 mm by 2.0 mm, 7.2 mm by 3.8 mm, etc. In a preferred embodiment, it has been found that foam pad thickness is less than or equal to 2.0 mm. Furthermore, the cleaning pad should be sufficiently sized to maximize cleaning efficiency without increasing frictional drag.

Figure 6:
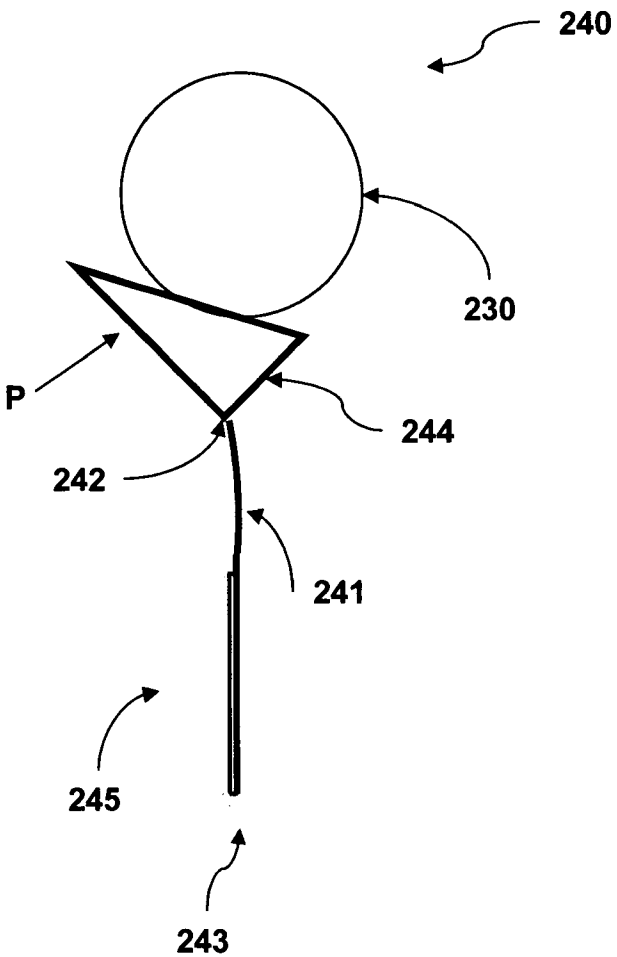
FIG. 6 is a side view of an exemplary embodiment of the charging member cleaning device of the present invention.
Figure 5:
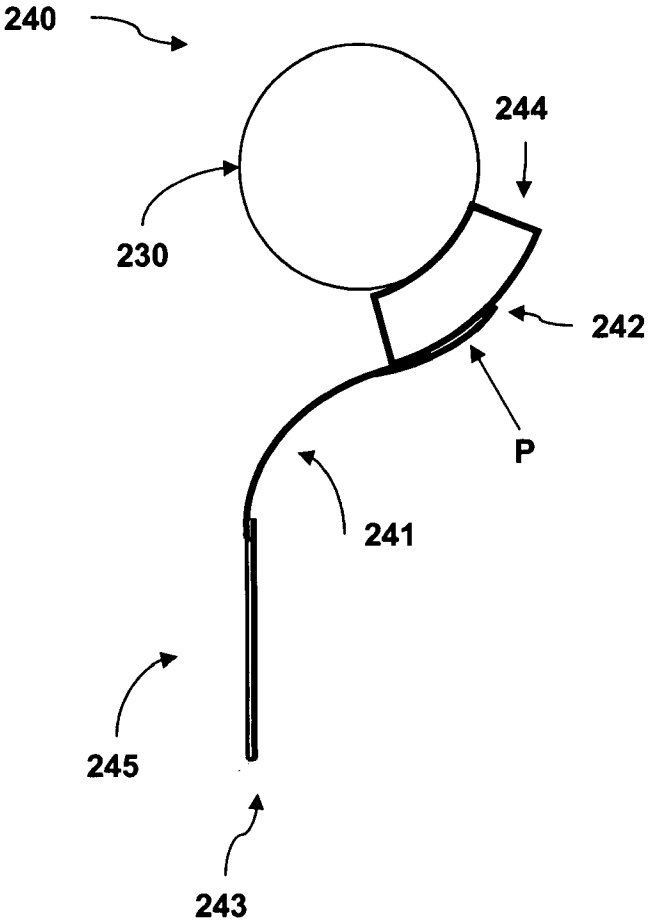
FIG. 5 is a side view of an exemplary embodiment of the charging member cleaning device of the present invention.

As illustrated in FIG. 3, the cleaning pad (244) may be affixed to the substrate (241) so that the proximal end of the cleaning pad coincides with the proximal end of the substrate (242). However, the substrate (241) may be positioned so that the proximal end of the substrate (242) supports only about half of the length of the cleaning pad (244), as illustrated in FIG. 5. Furthermore, the substrate (241) may be positioned so that the proximal end of the substrate (242) is attached at the bottom portion of the cleaning pad (244) as illustrated in FIG. 6.

In one embodiment, the cleaning pad may also be composed of foam, and may be open-celled foam. This is reference to a foam that includes open cells that permit the passage of air. The open cell foam may therefore absorb and retain contaminant material from the charging device and may prevent the contaminants from reattaching to the charging device and/or dislodging from the foam and contaminating other components in the printer. The foam may be composed of a polymer material including, but not limited to, polyurethane, a polyolefin including polyethylene, or silicone.

Polyurethane foam may be obtained from, for example, Foamex International Inc., PA. The foam may have a pore size of 50-150 pores per linear inch, and all increments therebetween including, 50-100 pores/linear inch, 100-150 pores/linear inch, 80-100 pores per linear inch, etc.

In another embodiment, the foam may have a density of 1.0 to 4.0 pounds per square foot, and all increments therebetween including 1.8-2.0 pounds per square foot, 1.5-2.0 pounds per square foot, 2.0-2.5 pounds per square foot, etc. The foam may also have a tensile strength between 15-40 pounds per square inch and all increments therebetween, including 18 pounds per square inch, 27 pounds per square inch, 35 pounds per square inch, etc.

Furthermore, the cleaning pad should have sufficient wear resistance to withstand the usage associated with, e.g. 20,000 printed pages or the life of the electrophotographic device. The cleaning pad may also have sufficient temperature resistance to withstand the temperatures associated with running the electrophotographic device. In other words, the substrate (241) as well and the cleaning pad (244) may be selected such that their ability to provide pressure to the roller may not be effected by temperature exposure in the printer. In one embodiment, the temperature exposure may be up to and between 40 and 70 degrees Celsius in the approximate area of the charging device. The temperature may also be any incremental value therebetween including about 45 degrees Celsius, 55 degrees Celsius, 65 degrees Celsius, etc. The cleaning pad may also have a surface that maximizes cleaning efficiency without increasing frictional drag.

Turning back to FIG. 3, the cleaning pad (244) may be affixed to the strip by an adhesive layer (246). The adhesive may be applied directly to the substrate or may be carried on foam or film which is applied to the substrate. The adhesive may be a hot melt adhesive or a pressure sensitive adhesive. The adhesive may be an acrylic, epoxy, or rubber based, such as styrene block copolymer. In one embodiment, the adhesive may be a double coated acrylic adhesive product supplied by the 3M Corporation, St. Paul, Minn., under the product code name 9500PC.

Figure 7:
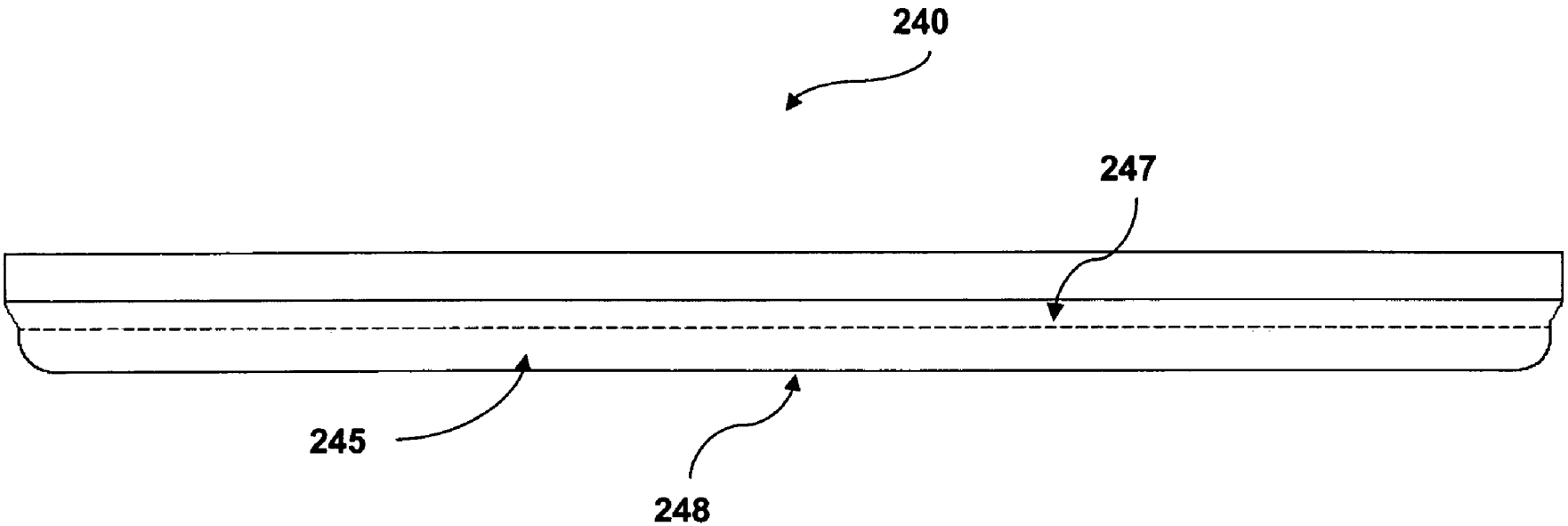
FIG. 7 is a front of an exemplary embodiment of the charging member cleaning device of the present invention.

The cleaning pad may also be affixed to the strip by heat staking, ultrasonic welding, or by mechanical attachment. The distal end of the strip (243) may be affixed to a bracket (250), illustrated in FIG. 2, using an adhesive (245) or any of the other methods described above as well. It should be appreciated that the adhesive may be positioned on either side of the substrate according to the placement of the substrate in the image-forming device (20), illustrated in FIG. 1. In one embodiment, as illustrated in FIG. 7, the area between the dotted line (247) and the edge of the substrate (248) is where a layer of adhesive (245) may be applied to the cleaning member (240) in order to attach the cleaning member to the bracket, (illustrated in FIG. 2). It should be appreciated that the adhesive may be applied in a continuous layer as depicted or applied in selected spots along the strip.

Figure 8:
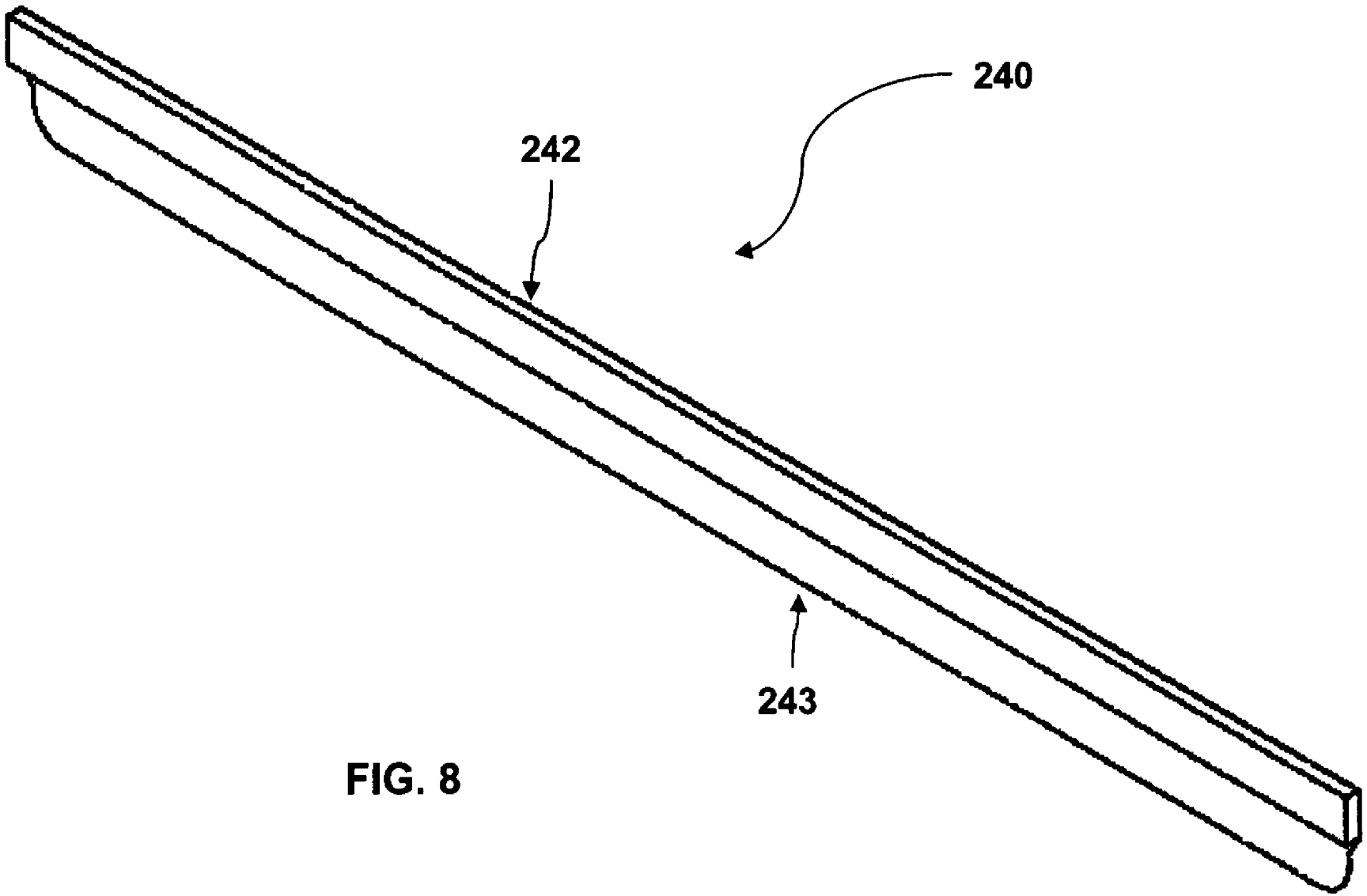
FIG. 8 is an isometric view of an exemplary embodiment of the charging member cleaning device of the present invention.

FIG. 8 depicts an isometric view of the cleaning member (240). The cleaning member may be long enough to accommodate the length of the charge roller or the image surface of the photoconductor. It should also be appreciated that the cleaning member may be longer than the cleaning pad or that the cleaning pad may be longer than the cleaning member. In one embodiment, the cleaning member may approximately be between 200-245+/−0.5 mm and all increments therebetween, including 224+/−0.5 mm, 215+/−0.5 mm, etc. It should also be appreciated that the distal end (243) of the cleaning member may be longer or shorter than the proximal end (242) of the cleaning member.

The foregoing description is provided to illustrate and explain the present invention. However, the description hereinabove should not be considered to limit the scope of the invention set forth in the claims appended here to.

What is claimed is:

1. A cleaning device for removing particulate from a charging device in an electrophotographic device comprising:

a flexible, elongated substrate including a pad comprising open-cell foam capable of absorbing and retaining particulate, said pad including a concave engaging surface having a length of 4.0-8.0 mm;

said substrate having first and second portions, wherein said substrate comprises a material having a flexural modulus less than or equal to 400,000 psi, and wherein said substrate is capable of being flexed to be positioned between said charging device and a surface in said electrophotographic device;

wherein said first and second portions define an angle of less than 180 degrees, and wherein said substrate, as positioned between said charging device and said surface in said electrophotographic device applies a pressure onto said pad when said pad contacts said charging device and said pad configured to engage and apply a cleaning pressure to and absorb and retain particulate from said charging device along said length of said pad concave engaging surface.

2. The device of claim 1, wherein flexing of said substrate provides an elastic response.

3. The device of claim 2, wherein said polymer is selected from the group consisting of polyester, polycarbonate, polyetherimide film or mixtures thereof.

4. The device of claim 2, wherein said elastic response provides a cleaning pressure upon said charging device, wherein said pressure is 0.01-5.0 psi.

5. The device of claim 1, wherein said substrate comprises a polymer.

6. The device of claim 1, wherein said substrate is between 0.002 inches and 0.004 inches in thickness.

7. The device of claim 1, wherein said foam is selected from the group consisting of polyurethane, polyolefins, silicone or mixtures thereof.

8. The device of claim 1, wherein said foam has a thickness of up to about 2.0 mm.

9. The device of claim 1, wherein said foam has a pore size between 50-150 pores per linear inch.

10. The device of claim 1, further comprising an adhesive layer disposed between said pad and said substrate, wherein said adhesive layer affixes said pad to said substrate.

11. The device of claim 1, further comprising an adhesive layer disposed between said substrate and said surface of said electrophotographic device, wherein said adhesive layer affixes said substrate to said surface of said electrophotographic device.

12. An electrophotographic device comprising:

a photoconductor;

a charging device contacting said photoconductor;

a flexible, elongated substrate including a pad comprising open-cell foam capable of absorbing and retaining particulate, said pad including a concave engaging surface having a length of 4.0-8.0 mm;

said substrate comprises a material having a flexural modulus less than or equal to 400,000 psi and having first and second portions, wherein said substrate is capable of being positioned between said charging device and a surface in said electrophotographic device, wherein said first and second portions define an angle of less than 180 degrees, and wherein said substrate, as positioned between said charging device and said surface in said printer, applies a pressure onto said pad, when said pad contacts said charging device, and said pad configured to engage and apply a cleaning pressure to and absorb and retain particulate from said charging device along the length of said pad concave engaging surface.

13. A method of cleaning a charging device in a printer comprising:

supplying a flexible, elongated substrate including a cleaning material comprising open-celled foam capable of absorbing and retaining particulate having a concave engaging surface having a length of 4.0-8.0 mm to engage said charging device;

said substrate having first and second portions wherein said first portion and second portion define an angle of less than 180 degrees and wherein said substrate is capable of being positioned as between a charging device and a surface in said printer; and flexing said substrate comprising a material having a flexural modulus less than or equal to 400,000 psi as between said charging device and said surface in said printer wherein said flexing provides an elastic response;

said foam applying a cleaning pressure of 0.01-5.0 psi to and absorbing and retaining particulate from said charging device along the length of said foam concave engaging surface.

14. The method of claim 13, wherein said elastic response causes a pressure as between said cleaning material and said charging device.

15. The method of claim 13, further comprising cleaning said charging device by contacting said cleaning material to said charging device.

16. A cleaning device for a printer comprising:

a flexible, elongated substrate comprises a material having a flexural modulus less than or equal to 400,000 psi including a cleaning material comprising open cell foam capable of absorbing and retaining particulate;

said substrate in a flexed state exhibiting an elastic response and having first and second portions, wherein said first portion and second portion define an angle of less than 180 degrees and said foam having a concave engaging surface having a length of 4.0-8.0 mm to engage a charging device and apply a cleaning pressure to and absorb and retain particulate from said charging device along the length of said concave engaging surface.

* * * * *